United States Patent [19]

Roberts et al.

[11] 3,946,553

[45] Mar. 30, 1976

[54] TWO-STAGE PREMIXED COMBUSTOR

[75] Inventors: Richard Roberts, Marlborough; Alexander Vranos, Rockville; Barry C. Schlein, Wethersfield; David H. Rummel, Manchester, all of Conn.

[73] Assignee: United Technologies Corporation, Hartford, Conn.

[22] Filed: Mar. 10, 1975

[21] Appl. No.: 557,008

[52] U.S. Cl. ..... 60/39.74 R; 60/39.65

[51] Int. Cl.[2] ..... F02G 3/00

[58] Field of Search ..... 431/352, 284, 285; 60/39.65, 39.74 R, 39.71

[56] References Cited

UNITED STATES PATENTS

| | | | |
|---|---|---|---|
| 3,048,014 | 8/1962 | Schmidt | 60/39.65 |
| 3,360,929 | 1/1968 | Drewry | 60/39.65 |
| 3,739,576 | 6/1973 | Chamberlain | 60/39.74 R |

*Primary Examiner*—Carroll B. Dority, Jr.
*Attorney, Agent, or Firm*—Charles A. Warren

[57] ABSTRACT

A two-stage premix combustor in which the primary flow flameholder and secondary flow flameholders are axially separated and each is arranged for optimum emissions control, with the fuel injected, atomized and at least partially vaporized external to the burning zone.

10 Claims, 1 Drawing Figure

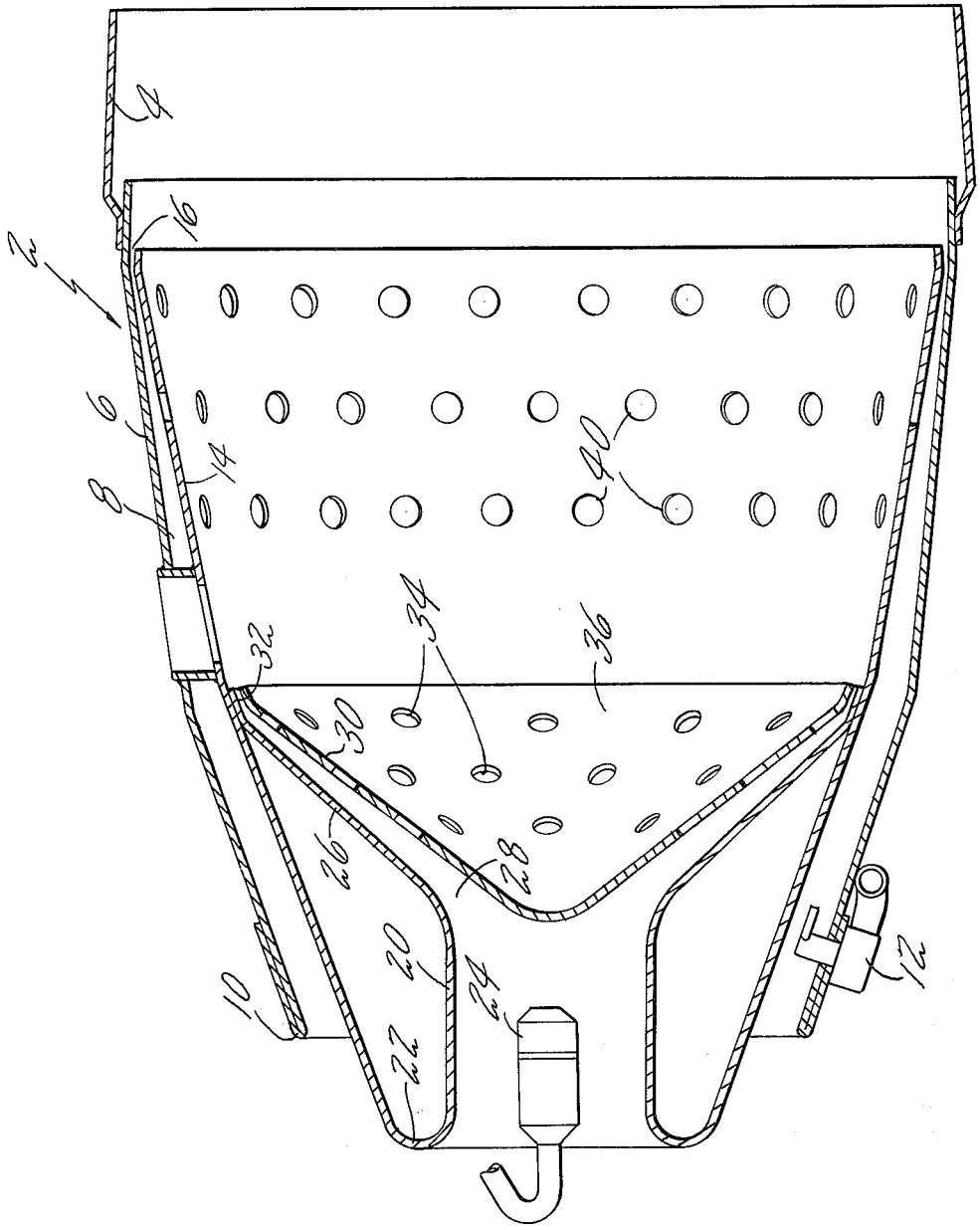
2
4
6
8
10
12
14
16
20
22
24
26
28
30
32
34
36
40

TWO-STAGE PREMIXED COMBUSTOR

SUMMARY OF THE INVENTION

Control of high power emissions requires the opposite extreme in recirculation zone design as the control of low power emissions. It has been found that by physically separating the primary or low power zone from the secondary or high power zone the design of each zone may be optimized for the extremes of the respective operating conditions. The result is a reduction in nitrogen oxide emissions at high power and in carbon monoxide and unburned hydrocarbon emissions at low power.

According to this invention, the primary zone has a premix passage expanding in a downstream direction from a central fuel nozzle and surrounding air passage with the primary combustion zone centrally located adjacent the annular discharge end of the premix passage surrounding the primary passage terminating at a point downstream of the primary discharge passage, with the secondary combustion zone surrounded by the secondary premix passage adjacent the discharge end and axially spaced from the primary combustion zone.

The foregoing and other objects, features, and advantages of the present invention will become more apparent in the light of the following detailed description of preferred embodiments thereof as illustrated in the accompanying drawing.

BRIEF DESCRIPTION OF THE DRAWING

The single FIGURE is a longitudinal sectional view through the premix and combustion zones of a flame tube.

DESCRIPTION OF THE PREFERRED EMBODIMENT

The invention shown is incorporated in a flame tube 2 of the type to be positioned individually within a burner can, not shown, or as one of a group of cans in an annular burner case. The flame tube 2 has a downstream annular ring 4, to the upper end of which is secured an outer sleeve 6, this sleeve forming the outer wall of the secondary premix passage 8. This sleeve may be somewhat frustoconical, increasing in diameter in a downstream direction. The upper end 10 of the sleeve is open for admission of air to the passage 8. Suitable fuel injector nozzles 12 are positioned in the sleeve 6 adjacent the upstream end for the admission of fuel either as fuel or atomized with air into the passage 8.

The inner wall of passage 8 is formed by an inner sleeve 14 positioned substantially concentric to the outer sleeve and substantially coextensive with the outer sleeve. The inner sleeve 14 increases in diameter in a downstream direction at a slightly greater rate than the outer sleeve so that the passage 8 has an increasingly smaller crosswise dimension in a downstream direction. The sleeves are spaced apart at the downstream end of the inner sleeve to form an annular discharge opening 16 for the premix passage.

Within the upper end of the inner sleeve 14 is a cylindrical tube 20 having its upstream end open to form an air inlet for the primary zone. The upper end of the tube is connected to the upper end of the inner sleeve 14 as shown by a curved annular connector 22. Within the tube 20 is a primary fuel nozzle 24 discharging either fuel or a mixture of fuel and air into the tube.

The tube 20 is relatively short and its downstream end connects with a frustoconical sleeve 26 which extends outwardly into engagement with the inner sleeve 14 substantially midway between its ends. The tube 20 and sleeve 26 form the outer wall of the primary premix zone or passage 28. The inner wall of this zone is formed by a conical member 30 concentric to and within the sleeve 26, and spaced laterally therefrom to define the passage 28 as a substantially frustoconical passage. The walls of this passage converge to form a convergent passage and the outer edge of the conical member 30 is laterally spaced from the downstream end of sleeve 26 to define the annular discharge opening 32 for this primary premix zone.

The conical member 30 has a plurality of openings 34 for the admission of premixed fuel and air from passage 28 into the space 36 within the cone. This space thus becomes the combustion zone for the primary combustible mixture. The conical member 30 acts as a flameholder and is so dimensioned that the primary mixture is provided a uniform and sufficient residence time therein for optimum burning.

In the arrangement shown the premix passages provide high velocity with no dead flow areas to trap liquid fuel thereby improving mixture uniformity and avoiding any burning upstream of the flameholders.

The inner sleeve 14 has a plurality of openings 40 therein adjacent the downstream end and all located in spaced relation to the downstream edge of the conical member 30. These openings and the position of the lower edge of the inner sleeve 14 establish the secondary combustion zone adjacent the lower portion of the inner sleeve and in axial spaced relation downstream of the primary combustion zone, thereby minimizing quenching of the primary combustion by secondary flameholder air during idle operation.

The arrangement of both flameholders are of spherical reactor configuration to provide flat temperature profiles at the exit of the burning zones.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A combustor construction having axially separated primary and secondary premix stages, the secondary premix stage including:

an outer diverging sleeve forming the outer wall of the secondary fuel and air mixture passage, an inner diverging sleeve within and spaced from the outer sleeve and defining the inner wall of said passage, said sleeves being arranged to form a passage decreasing in crosswise dimension in the direction of flow therethrough, and being closely spaced at the downstream end of the inner sleeve to form an annular discharge passage, said inner sleeve having rows of openings therethrough and defining within said sleeve a secondary flameholder, and the primary premix stage including:

a frustoconical outer sleeve within said inner diverging sleeve and secured thereto, an inner substantially conical member within and spaced from said frustoconical outer sleeve and defining therewith a diverging annular passage for the primary fuel and air mixture, said diverging passage decreasing in transverse dimension in a downstream direction, the downstream edge of the conical member being closely spaced from the outer frustoconical sleeve to define an annular discharge passage for the primary mixture, and said conical member having a plurality of openings therein and forming a primary flameholder.

2. A combustor as in claim 1 in which the openings in the inner diverging sleeve are all spaced downstream of the downstream edge of the conical member.

3. A combustor as in claim 1 in which a plurality of fuel nozzles are supported in the upper portion of one of said diverging sleeves for supplying fuel to the secondary mixture passage.

4. A combustor as in claim 1 in which at least one fuel nozzle is positioned adjacent the upstream end of the annular diverging passage.

5. A combustor as in claim 1 in which the upstream ends of both passages are open for the admission of combustion supporting gas.

6. A combustor as in claim 1 including an annular flame tube skirt is attached to and extends downstream from the outer diverging sleeve.

7. A combustor as in claim 1 in which the upper ends of the inner diverging sleeve and the outer frustoconical sleeve are interconnected to divide the air flow into said primary and secondary passages.

8. A flame tube inlet construction including:

a substantially cylindrical sleeve defining a primary inlet, at least one primary fuel nozzle in said inlet, a first downstream diverging member extending from the upstream end of said sleeve and forming the inner wall of a secondary passage, for a secondary fuel and air mix, a second downstream diverging member secured to and extending from the downstream end of said sleeve and forming the outer wall of a primary diverging passage, the downstream end of said second diverging member being secured to the first diverging member between the ends thereof, a substantially conical member positioned within and spaced from the second diverging member and forming the inner wall of a primary diverging passage, for a primary fuel and air mix, the downstream end of said conical member terminating adjacent the downstream end of said second diverging member to form and annular outlet an outer diverging member surrounding and in spaced relation to said first diverging member and defining therebetween a primary passage, and being closely spaced at the downstream ends to form an annular discharge passage.

9. A flame tube inlet construction as in claim 8 in which both said conical member and said first diverging member adjacent its downstream end have openings therein for the flow of mix in said passages through said openings.

10. A flame tube inlet construction as in claim 9 in which space immediately downstream of the conical member forms a primary flameholder area, and the space within the first diverging member below the attachment of the second diverging member thereto defining a secondary flameholder area, the openings in the second diverging member being all spaced downstream from the openings in the conical member.

* * * * *